US008172618B1

(12) United States Patent
Wang

(10) Patent No.: US 8,172,618 B1
(45) Date of Patent: May 8, 2012

(54) SEMICONDUCTOR-TYPE ELECTRIC CONNECTOR

(75) Inventor: Robert Wang, Luch (TW)

(73) Assignee: Ceramate Technical Co., Ltd., Taoyuan County (TW)

( * ) Notice: Subject to any disclaimer, the term of this patent is extended or adjusted under 35 U.S.C. 154(b) by 27 days.

(21) Appl. No.: 12/947,901

(22) Filed: Nov. 17, 2010

(51) Int. Cl.
*H01R 13/66* (2006.01)

(52) U.S. Cl. ..... 439/620.08; 439/620.1; 439/620.12

(58) Field of Classification Search ..... 439/620.08, 439/620.1, 620.09, 620.12
See application file for complete search history.

(56) References Cited

U.S. PATENT DOCUMENTS

| | | | | |
|---|---|---|---|---|
| 5,018,989 | A * | 5/1991 | Black et al. | 439/620.1 |
| 5,967,802 | A * | 10/1999 | Daly et al. | 439/76.1 |
| 6,134,093 | A * | 10/2000 | Masghati | 361/119 |
| 6,652,292 | B2 * | 11/2003 | Pratt et al. | 439/76.1 |
| 7,442,085 | B2 * | 10/2008 | Fuerst et al. | 439/620.09 |
| 7,775,833 | B1 * | 8/2010 | Le et al. | 439/620.08 |
| 2010/0248547 | A1 * | 9/2010 | Sidiki et al. | 439/620.22 |

* cited by examiner

*Primary Examiner* — Gary F. Paumen
(74) *Attorney, Agent, or Firm* — Ming Chow; Sinorica, LLC

(57) ABSTRACT

A semiconductor-type electric connector against surge and static electricity includes a circuit board in the electric connector. The circuit board is provided with conductive terminals for external connection. The circuit board includes at least one electronic component which is a semiconductor chip. The electronic component is electrically connected to the conductive terminals of the circuit board in a parallel connection. The electronic component is conducted in a specific state, so that the electric connector is capable of being against surge and static electricity and convenient for maintenance.

6 Claims, 4 Drawing Sheets

SEMICONDUCTOR-TYPE ELECTRIC CONNECTOR

BACKGROUND OF THE INVENTION

1. Field of the Invention

The present invention relates to an electric connector capable of being against surge and static electricity.

2. Description of the Prior Art

An electronic apparatus always uses an electric connector having a different function for transmitting signal, data or lower-pressure power source to an external electronic apparatus. The electric connector is a USB, HDMI or the like. FIG. 1 is an exploded view of a USB connector. The USB connector comprises a housing 1 and a base 2 in the hosing 1. One end of the base 2 is connected with a tongue plate 3 which is suspended toward an opening of the housing 1. A number of parallel conductive plates 4 are provided in the housing 1. The front end of the conductive plate 4 is formed with a conductive terminal for connecting with an external electronic apparatus. Another end of the conductive plate 4 is bent downward to form a pin for being welded to the electronic apparatus. The circuit board of the electronic apparatus is provided with protective components, such as diodes, to prevent the electronic components in the electronic apparatus from damage because of large current from the electric connector or to prevent signal interference caused by the static electricity. Once the protective components malfunction, it is not easy for the user to make a replacement.

SUMMARY OF THE INVENTION

The primary object of the present invention is to provide a semiconductor-type electric connector against surge and static electricity. The electric connector comprises a housing. The housing has an opening at a front end thereof. A circuit board is transversely suspended in the housing. One end of the circuit board is disposed in the opening of the housing and has a surface printed with a plurality of conductive terminals. Another end of the circuit board is provided with a plurality of connecting pins. The connecting pins are electrically connected with the respective conductive terminals in a series connection. The circuit board comprises at least one electronic component which is a semiconductor chip. The electronic component is conducted in a specific state, so that the electric connector is capable of being against surge and static electricity and convenient for maintenance.

DETAILED DESCRIPTION OF THE PREFERRED EMBODIMENTS

Embodiments of the present invention will now be described, by way of example only, with reference to the accompanying drawings.

Figure 1:
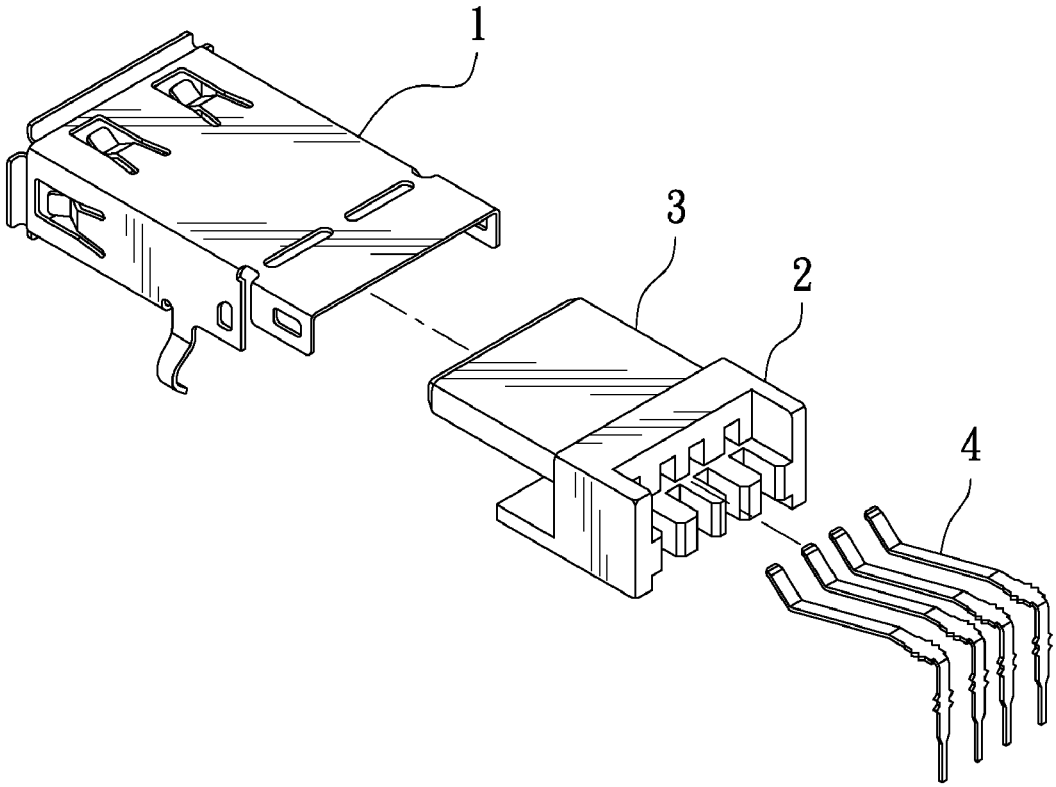
FIG. 1 PRIOR ART
FIG. 1 is an exploded view of an electric connector.
Figure 2:
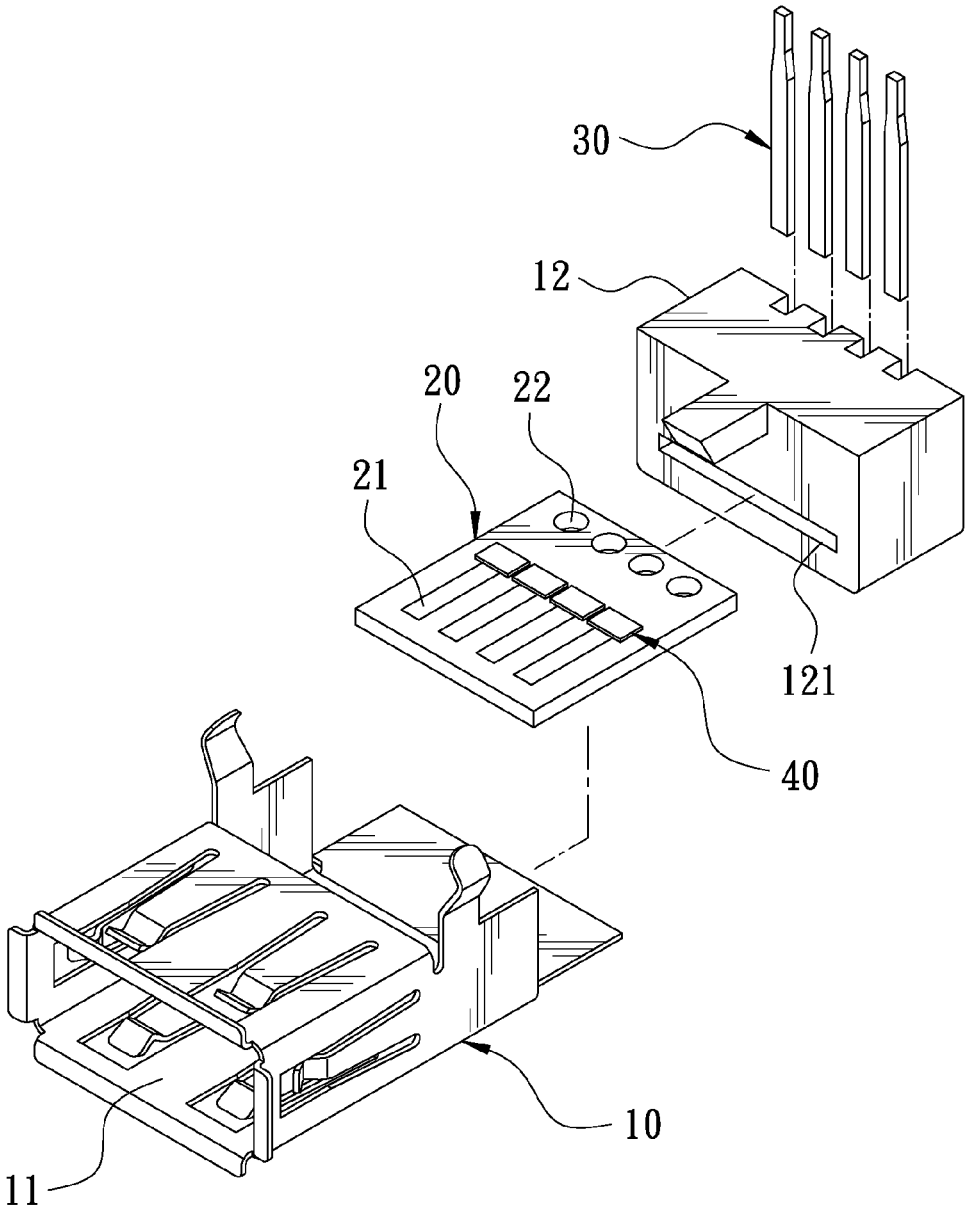
FIG. 2 is an exploded view according to a preferred embodiment of the present invention.
Figure 3:
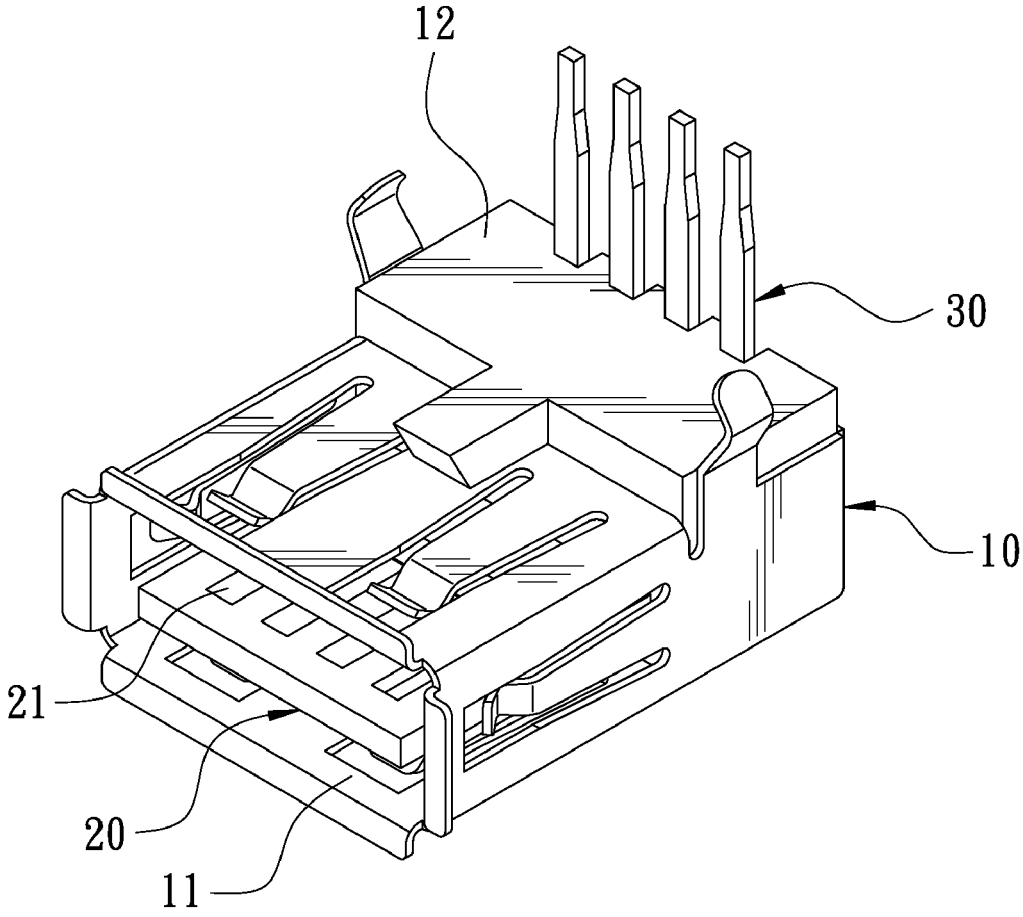
FIG. 3 is a perspective view according to the preferred embodiment of the present invention.

As shown in FIG. 2 and FIG. 3, a semiconductor-type electric connector according to a preferred embodiment of the present invention comprises a housing 10, a circuit board 20, a plurality of connecting pins 30 and a plurality of electronic components 40.

The housing 10 is made of a metallic material and in a rectangular shape. The housing 10 has an opening 11 at a front end thereof and a seat 12 at a rear end thereof. The seat 12 has a transverse insertion slot 121.

The circuit board 20 has a front end and a rear end. The rear end of the circuit board 20 is inserted in the insertion slot 121 of the seat 12. The front end of the circuit board 20 is suspended in the opening 11 of the housing 10. The front end of the circuit board 20 has a surface printed with a plurality of conductive terminals 21. The conductive terminals 21 are direct formed on the circuit board 20 with a copper foil conducting material. The rear end of the circuit board 20 is formed with a plurality of holes 22 corresponding to the conductive terminals 21. The conductive terminals 21 are electrically connected with the corresponding holes 22, respectively. In this embodiment, there are four conductive terminals 21, namely, a power source terminal, a ground terminal, a signal transmitting terminal (Tx) and a signal receiving terminal (Rx).

The connecting pins 30 are made of a metallic material. There are four connecting pins 30 in this embodiment. The connecting pins 30 correspond to the relative holes 22. One end of each connecting pin 30 is welded to a corresponding hole 22, such that the connecting pins 30 are electrically connected to the respective conductive terminals 21 in a series connection. Another end of each connecting pin 30 is extended out of the housing 10.

Figure 4:
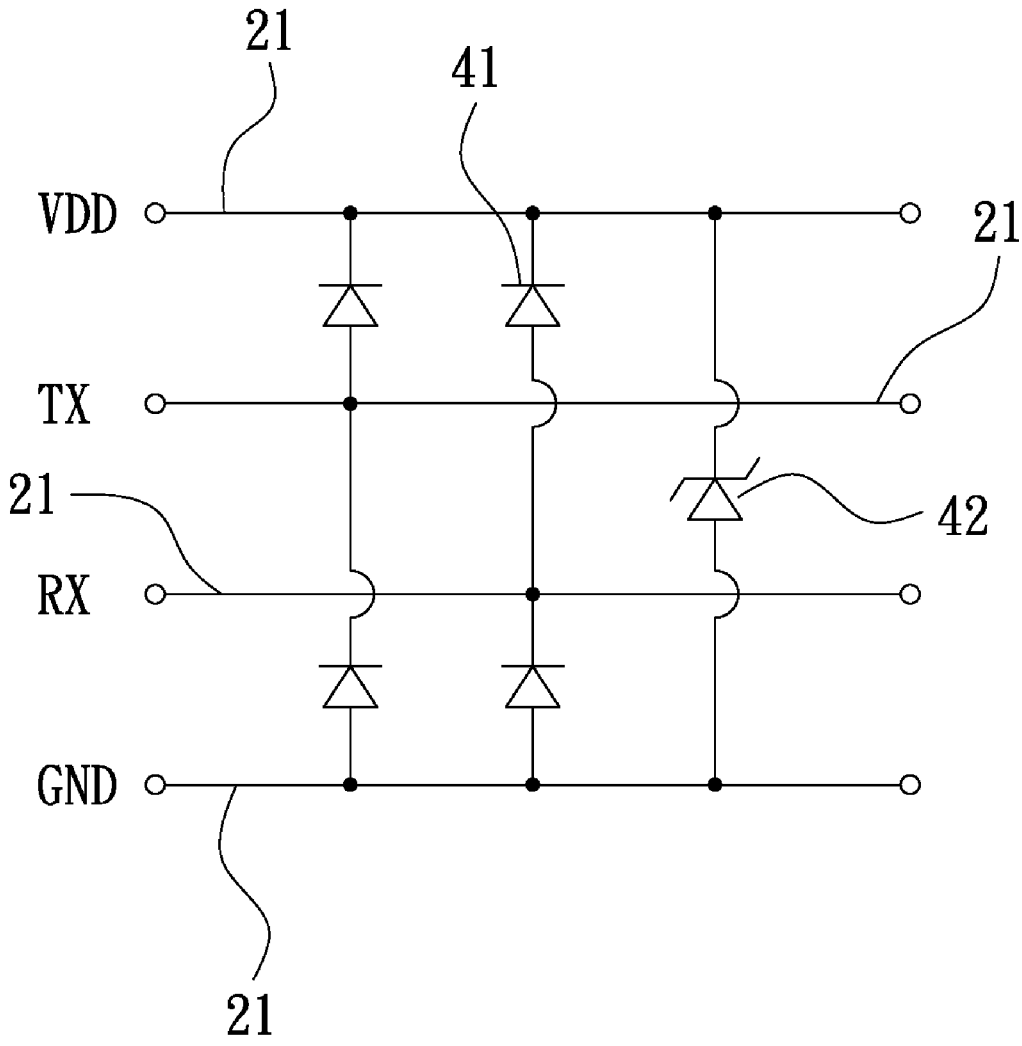
FIG. 4 is a circuit diagram according to a preferred embodiment of the present invention.

The electronic components 40 are made of semiconductor chips and disposed on the surface of the circuit board 20. The plurality of electronic components 40 are electrically connected to the conductive terminals 21 in a parallel connection. The plurality of electronic components 40 are conducted in a specific state. Referring to FIG. 4, in this embodiment the electronic components 40 include four diodes 41 and one Zener diode 42. One diode 41 is connected between the power source terminal and the signal transmitting terminal (Tx); another diode 41 is connected between the ground terminal and the signal transmitting terminal (Tx); another diode 41 is connected between the power source terminal and the signal receiving terminal (Rx); the other diode 41 is connected between the ground terminal and the signal receiving terminal (Rx). The Zener diode 42 is connected between the power source terminal and the ground terminal.

When the present invention is connected with an external electronic apparatus, the present invention is used to transmit signal, data, or lower-pressure power source for the external electronic apparatus to work. When in a normal use, the electronic components 40 are not conducted. In case of over current caused by a surge or abnormal voltage caused by static electricity, the electronic components 40 will be conducted for guiding the over current or voltage to the ground terminal so as to protect other circuit components and to ensure the right signal.

The present invention has the following advantages:

1. Convenient maintenance. If the electronic components in the electric connector of the present invention malfunction when the electronic apparatus is in use, it is only required to replace the electric connector of the present invention, without replacing the protection components and the whole circuit board therein.

2. Integral design. The present invention uses the circuit board instead of the tongue plate of the prior art, so that the protective electronic components can be direct mounted on the circuit board. The protective electronic components are integral with the electric connector, without additional protective electronic components to be installed on the electronic apparatus so as to reduce the size of the electronic apparatus.

3. Without the need to change specification. The present invention uses the circuit board instead of the tongue plate of the prior art, so that the protective electronic components can be direct mounted on the circuit board. Besides, the protective electronic components are made of semiconductor chips which are direct mounted on the circuit board. There is no need for packaging so as to reduce the whole size. The protective electronic components can be disposed in an existing housing, without the need to change the specification of the electric connector.

4. Saving manufacture cost. The protective electronic components of the present invention are direct mounted on the circuit board, without the procedure to mount the protective electronic components on the electronic apparatus. Thus, the area of the circuit board in the electronic apparatus and the manufacture cost can be reduced.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A semiconductor-type electric connector, comprising:

a housing having an opening at a front end thereof and a seat at a rear end thereof, the seat having a transverse insertion slot;

a circuit board having a front end and a rear end, the rear end of the circuit board being inserted in the insertion slot of the seat, the front end of the circuit board being suspended in the opening of the housing, the front end of the circuit board having a surface printed with a plurality of conductive terminals, the rear end of the circuit board being formed with a plurality of holes corresponding to the conductive terminals, the conductive terminals being electrically connected with the corresponding holes;

a plurality of connecting pins made of a metallic material, the connecting pins each corresponding to the relative hole, one end of each connecting pin being welded to the relative hole, the connecting pins being electrically connected to the respective conductive terminals in a series connection, another end of each connecting pin extending out of the housing; and a plurality of electronic components made of semiconductor chips and disposed on the surface of the circuit board, the plurality of electronic components being electrically connected to the conductive terminals in a parallel connection, the plurality of electronic components being conducted in a specific state so that the electric connector is protected against surge and static electricity.

2. The semiconductor-type electric connector as claimed in claim 1, wherein the electronic components are diodes.

3. The semiconductor-type electric connector as claimed in claim 1, wherein the electronic components are Zener diodes.

4. The semiconductor-type electric connector as claimed in claim 1, wherein the conductive terminals are direct formed on the circuit board with a copper foil conducting material.

5. The semiconductor-type electric connector as claimed in claim 1, wherein the conductive terminals include four conductive terminals, a power source terminal, a ground terminal, a signal transmitting terminal (Tx) and a signal receiving terminal (Rx).

6. The semiconductor-type electric connector as claimed in claim 5, wherein the electronic components include four diodes and one Zener diode, wherein one diode is connected between the power source terminal and the signal transmitting terminal (Tx); another diode is connected between the ground terminal and the signal transmitting terminal (Tx); another diode is connected between the power source terminal and the signal receiving terminal (Rx); the other diode is connected between the ground terminal and the signal receiving terminal (Rx), wherein the Zener diode is connected between the power source terminal and the ground terminal.

* * * * *